US006408468B1

(12) United States Patent
Comfort

(10) Patent No.: US 6,408,468 B1
(45) Date of Patent: Jun. 25, 2002

(54) PILLOW TO FACILITATE HEARING

(76) Inventor: Kristen Comfort, 816 Placek Dr., Johnson City, NY (US) 13790

( * ) Notice: Subject to any disclaimer, the term of this patent is extended or adjusted under 35 U.S.C. 154(b) by 0 days.

(21) Appl. No.: 09/907,865

(22) Filed: Jul. 19, 2001

(51) Int. Cl.[7] ..... A47G 9/10
(52) U.S. Cl. ..... 5/636; 5/638; 5/639; 5/498
(58) Field of Search ..... 5/636, 638, 639, 5/490

(56) References Cited

U.S. PATENT DOCUMENTS 1,580,210 A * 4/1926 McCulloch ..... 5/636
2,295,906 A * 9/1942 Lacour ..... 310/68 D
3,141,179 A * 7/1964 McLean ..... 5/636
4,375,112 A * 3/1983 Leonhart ..... 5/490
5,095,569 A * 3/1992 Glenn ..... 5/482
5,848,448 A 12/1998 Boyd
6,006,380 A 12/1999 Sramek
6,230,350 B1 5/2001 Goldstein

* cited by examiner

*Primary Examiner*—Michael F. Trettel
(74) *Attorney, Agent, or Firm*—Salzman & Levy

(57) ABSTRACT

A pillow that has an upper and a lower major surface and at least one hole for receiving a user's ear. The hole extends through the entire thickness of the pillow from the upper to the lower surface of the pillow. The pillow can be filled with conventional, resilient materials, or it can be an inflatable pillow filled with air. A pillowcase fits over the pillow with holes corresponding to the holes in the pillow. The pillowcase can also have a soft mesh material within the hole, or the entire pillowcase can be made of a soft mesh material.

5 Claims, 3 Drawing Sheets

PILLOW TO FACILITATE HEARING

FIELD OF THE INVENTION

The present invention relates to a pillow for the hard of hearing and, more particularly, to a pillow having holes that form channels going through the entire thickness of the pillow.

BACKGROUND OF THE INVENTION

Hearing impaired individuals obviously endure the trials and tribulations of daily life with more difficulty than do people with better hearing. With exception of hearing aids, not many products are available that are designed specifically for those who are hard of hearing. These groups of people face challenges in their daily life due to numerous low sound level and/or cacophonous circumstances. In addition to people who are hearing impaired in both ears, many individuals are hard of hearing in only one ear. Since many of these people do not wear any type of hearing aid, they are limited to hearing accurately from only one ear.

A major problem for people who are hard of hearing in one ear occurs when they use pillows. In particular, when a person lies on his or her side with the less functional ear faced upward, the properly functioning ear is in contact with the pillow. Due to the seal the good ear makes with the pillow or pillowcase, air is not able to carry sound waves to that ear. In this position, the person has difficulty hearing at all because the less functional ear is exposed to sound waves that it cannot hear, while the ear that functions properly is not exposed to sound waves.

Even people with no hearing handicap can benefit from using both of their ears. This invention, therefore, is not limited to the hard of hearing, as any person can use and gain a hearing advantage from the inventive pillow. The use of the term "hard of hearing" is intended herein to mean both individuals who are in fact hard of hearing, and those who have no hearing handicap.

There are numerous circumstances where lack of hearing while lying down can inconvenience the person or cause serious and dangerous problems. Oftentimes, for example, only one side of the head is placed on a pillow while watching television or listening to music from a bed or a couch. This situation requires the hard of hearing individual to sacrifice either comfort, or the ability to hear the television program or musical piece.

Another instance when a hard of hearing person can experience difficulty hearing while lying down occurs when a telephone rings. Most hearing-impaired individuals have telephones that alert the person being called by producing a sound and not by visual means. This can cause hard of hearing people not to know when their telephone is ringing, and thus miss a phone call.

A more serious and potential dangerous problem occurs while a hard of hearing person is lying down and a smoke or carbon monoxide alarm sounds. Even the high-pitched sound of a smoke alarm can go unheard by someone whose properly functioning ear is flush against a pillow or pillowcase. The sound waves that are produced by the alarm travel through the air and are received by the ear, if the ear is functioning properly. When someone is hard of hearing, of course, the sound may not be heard. The purpose of any audible alarm is lost when the sound it produces cannot be heard by the people that it is attempting to alert.

It is also extremely common for all types of individuals to set an alarm clock in order to wake themselves. People are generally not concerned about the orientation in which they sleep because, almost without fail, their alarm clock wakes them up at a pre selected time. Their ability to hear the alarm clock thus enables them to awaken. Waking up to the sound of an alarm clock is often a difficult task to ask of hard of hearing people. For these people to be able to hear their alarm clocks, they must sleep with their properly functioning ear upward, while their low functioning ear faces the opposite horizontal direction (sleeping on their stomach or back), or in contact with the pillow (sleeping on their side).

As aforementioned, even those with so-called normal hearing in both ears are reduced to hearing sounds received by only one ear when the other is covered. Thus, there would be an advantage to all people to hear with both ears when reclining on a pillow.

DISCUSSION OF RELEVANT ART

U.S. Pat. No. 6,006,380, issued to Shame on Dec. 28, 1999 for ADJUSTABLE CERVICAL PILLOW WITH DEPRESSIONS FOR A USER'S EAR, discloses an adjustable cervical pillow, with beautification properties, for supporting the head and neck of a person. An upper portion includes a central depression for accepting the back or side of the person's head, and a plurality of depressions for accepting the person's ear during use. The depressions for accepting an ear are disposed only in the upper portion, and do not penetrate the lower portion of the pillow.

In U.S. Pat. No. 5,848,448, issued to Body on Dec. 15, 1998 for PILLOW WITH CUTOUTS ADAPTED TO ACCOMMODATE THE EAR, NOSE, AND CHEEK OF A USER, a pillow that does not promote facial wrinkling or earaches has cutouts or wells positioned and shaped for receiving the facial tissue of a user so as to prevent wrinkles to the facial tissue. One cutout is designed to accept the ear of a person, another cutout is for accepting the nose and cheek, while another cutout is designed to receive the back of the user's head.

U.S. Pat. No. 6,230,350, issued to Gold stein on May 15, 2001 for HEAD SUPPORT PAD WITH AIR ACCESS CONDUIT, discloses a pillow for supporting the head in a face down position. A recess or wall provides a breathing void and at least one air flow conduit extends from the void to the ambient air. The recess and air flow conduits in the pillow provide air to the user to aid in breathing, while only the conduits extend through the pillow to supply the air. The recess does not extend entirely through the pillow.

SUMMARY OF THE INVENTION

In accordance with the present invention, there is provided a pillow with at least one hole for accepting a user's ear. The holes in the pillow extend through the entire thickness of the pillow with openings on both major surfaces thereof. The pillow can be filled using conventional pillow filling, or it can be an inflatable pillow with air used as the filler.

The present invention also provides a pillowcase that fits over the inventive pillow. While a typical pillowcase can also be used, the effectiveness of the pillow will be sacrificed. Thus, the pillowcase of the invention can have either an opening, or an opening filled with a type of mesh material that aligns with to the holes in the pillow. The pillowcase can also be made entirely of a mesh material.

When in use, the user places his or her ear over the opening of the pillowcase or over the hole in the pillow. While in this embodiment, an opening is adjacent to the user's ear that is filled with air. Since the pillow and pillowcase do not form a perfect seal with the top of the bed or sheet, no vacuum is formed; thus, air is capable of travelling into the hole in the pillow. The air within the pillow provides a means for sound waves to travel from their source to the user's ear. Therefore, the hard of hearing user can relax with either ear, either the normally functioning ear or the lower functioning ear, over the hole in the pillow or the opening in the pillowcase and still be able to watch television and hear a phone ringing.

To increase the effectiveness of the inventive pillow, the user can place his or her arm under the pillow, creating a gap between the pillow and the couch or bedding. This embodiment produces a large area of air for sound waves to freely flow through the hole in the pillow and to the user's ear.

The inventive pillow can also be used in order to relieve pressure from a user's ear while the person reclines. People who have undergone ear surgery are often limited to the orientation in which they lie because they do not want to put pressure on their ear. The inventive pillow allows them to lay comfortably on their side with their ear in the pillow's hole. People wearing hearing aids or earrings also reap similar benefits from using the inventive pillow. Since no additional pressure is put on their ear, the user of the inventive pillow does not experience the pain that would typically be felt using a standard pillow.

It is an object of this invention to provide a pillow that a person can use while still being able to hear from the ear in contact with the pillow.

It is another object of this invention to provide a pillow for a person without the use of an alternate mechanical and/or electrical device to enhance hearing.

It is another object of this invention to provide a pillow for a person who desires to have less pressure on their ear.

It is another object of this invention to provide a pillowcase containing holes or mesh that can be placed over the pillow, allowing air to pass through the pillowcase into the hole in the pillow.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same designation and numbering throughout all figures.

DESCRIPTION OF THE PREFERRED EMBODIMENT

Generally speaking, the invention is a pillow with one or more holes extending through its entire thickness for accepting a user's ear and a pillowcase for fitting over the pillow for allowing air to pass through the holes in the pillow.

Figure 2:
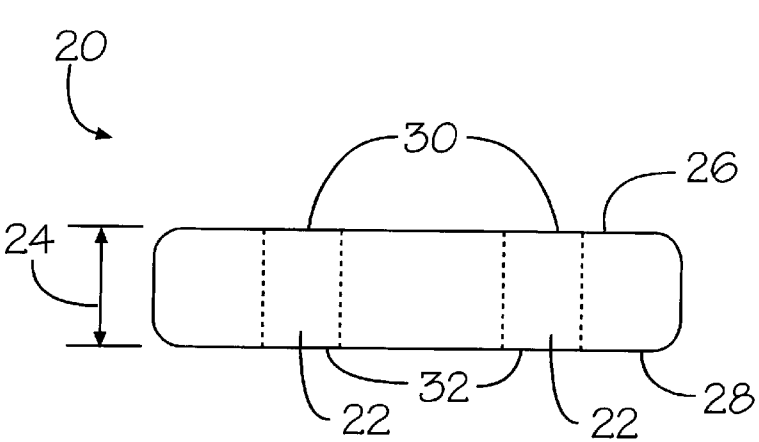
FIG. 2 illustrates a front view of the pillow shown in FIG. 1.
Figure 1:
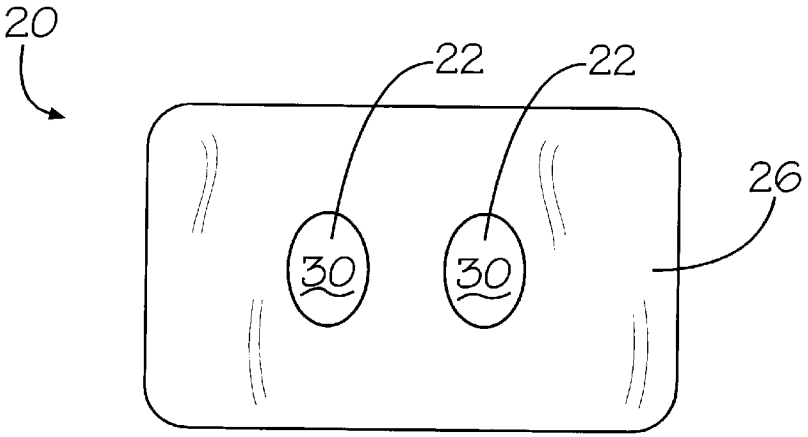
FIG. 1 illustrates a top view of a pillow containing two holes in accordance with the present invention.
Figure 3:
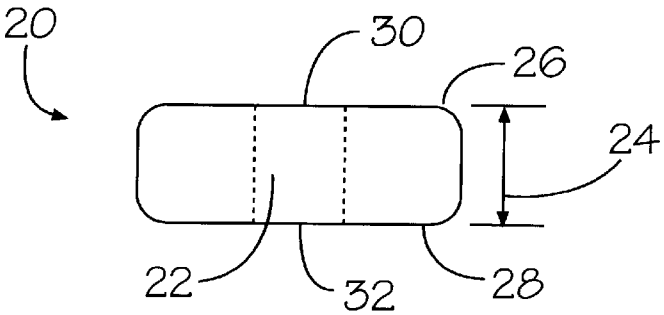
FIG. 3 illustrates a side view of the pillow shown in FIGS. 1 and 2.

Now referring to FIGS. 1–3, different views of a pillow are illustrated. The pillow, shown generally at reference numeral 20, contains at least one hole 22 extending through its entire thickness 24. For purposes of description, two holes 22 are depicted. The pillow 20 has substantially the same rectangular shape as a typical pillow, but need not be limited to that shape. Each hole 22 in pillow 20 has a general oval shape and is large enough for accepting a person's ear, as shown more clearly in FIGS. 7 and 8. Of course, the shape of the holes 22 need not be oval or elliptical, but may be any other shape selected to accommodate user preference and/or manufacturing convenience. The holes 22 are disposed between an opening 30 on the top major surface or face 26 of pillow 20 and a substantially equally sized opening 32 on the bottom face 28 thereof. The dimensions of the cross section of holes 22 are substantially consistent throughout the entire thickness 24 of pillow 20. The pillow 20 is filled either by conventional filling (foam, feathers, polyethylene, etc.), not shown, or with air.

Figure 5:
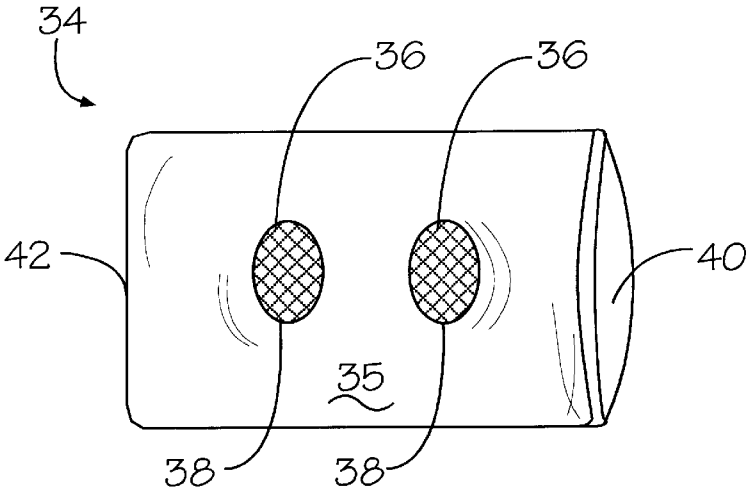
FIG. 5 illustrates a perspective view of an alternate embodiment of a pillowcase containing two mesh filled holes.
Figure 4:
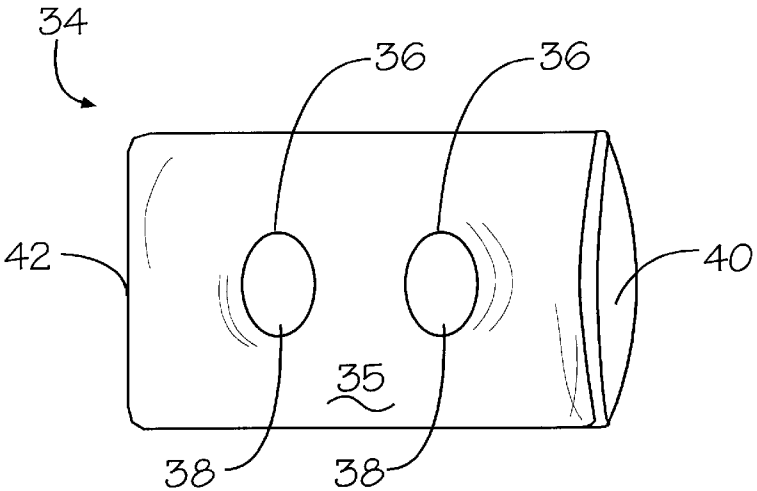
FIG. 4 illustrates a perspective view of a pillowcase containing two holes in accordance with the present invention.

Now referring to FIGS. 4 and 5, alternate embodiments of a pillowcase 34 are illustrated. The pillowcase 34 fits over the pillow 20 (FIGS. 1–3) in a conventional manner. An opening 40 is provided on one end of pillowcase 34, while the other end 42 is sewn shut or sealed. The pillowcase 34 contains two openings 36 on respective top surface 35 and the bottom surface (not shown) that correspond to the holes 22 in pillow 20 when pillow 20 is properly encased (not shown). An area 38 is defined by openings 36. Air is able to pass through these areas 38 and then continue through the holes 22 in pillow 20.

The pillowcase 34 in FIG. 5 includes an oval area of soft mesh 44 that fills the holes 36 on both the top surface 35 and bottom surface of pillowcase 34. Air is able to pass through mesh area 44 and continue through the holes 22 in pillow 20. A reason for using soft mesh 44 to cover the openings 36 of the pillowcase 34 is to accommodate a person's typical desire not to sleep on holes.

Figure 6:
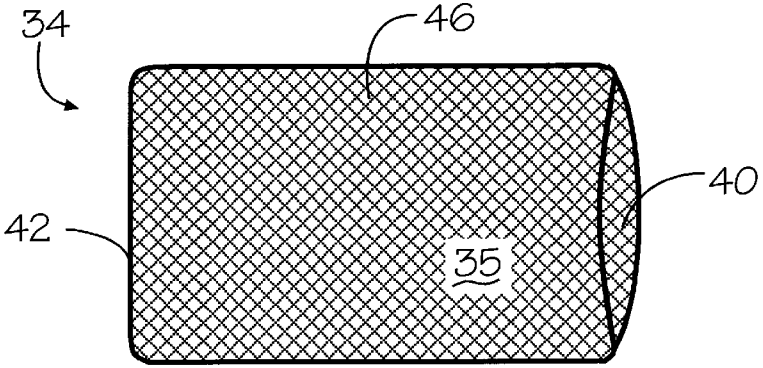
FIG. 6 illustrates a perspective view of yet another, alternate embodiment of a pillowcase made entirely of mesh.

The pillowcase 34 in FIG. 6 is made entirely of soft mesh 46. Both the top surface 35 and the bottom major surface of the pillowcase 34 are therefore covered by mesh 46, which provides a manufacturing advantage. Moreover, the mesh 46 ensures that wherever holes 22 are with respect to the pillow 20, air will be able to pass through these holes 22.

Figure 7:
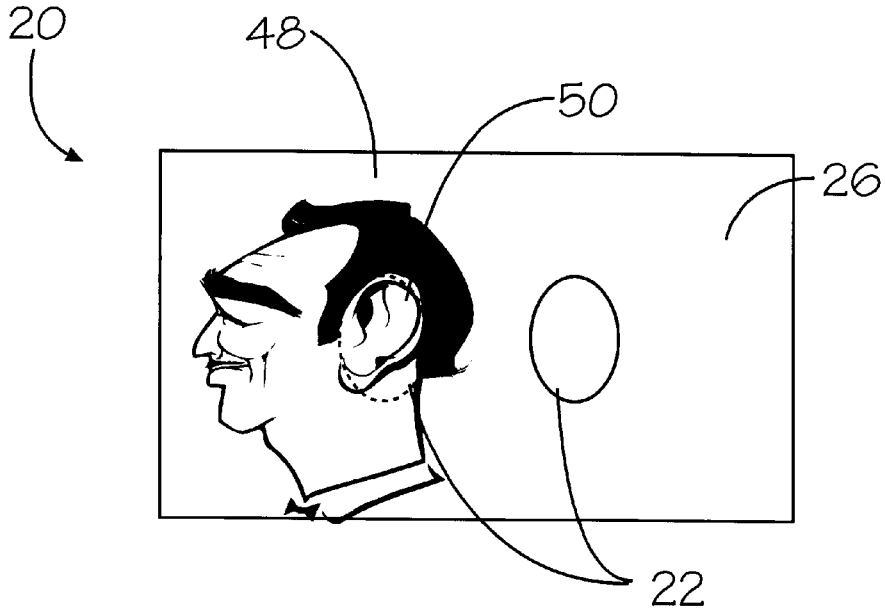
FIG. 7 illustrates a top, in situ view of the inventive pillow.
Figure 8:
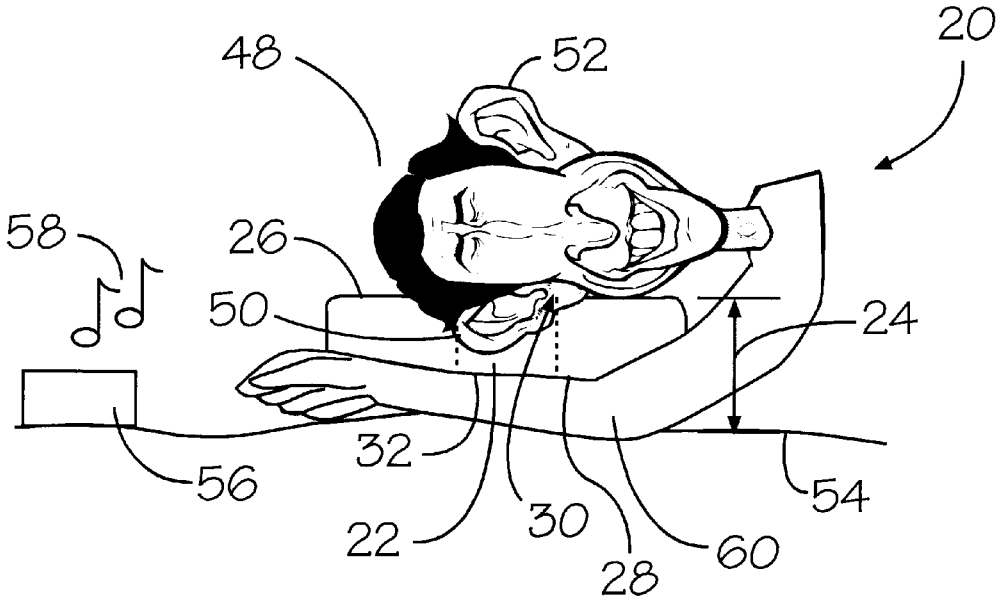
FIG. 8 illustrates an in situ view of the pillow shown in cross section.

Now referring to FIGS. 7 and 8, the pillow 20 without pillowcase is shown in use. A hole 22 in pillow 20 receives the ear 50 of the head of a person 48 lying thereon, while the other, exposed ear 52 is not in contact with the pillow 20. The top major surface 26 of pillow 20 is generally above the level of the ear 50 and is in contact with the user's face 48, while the bottom surface 28 is in contact with the bed or bedding material 54. When the person props the pillow 20 over his arm 60 (FIG. 8), the bottom surface 28 of pillow 20 does not make a tight seal with bed 54.

A sound source 56, such as a smoke alarm, telephone, stereo, television, etc., produces sound waves 58 that are able to travel to both of the user's ears 50, 52. Sound waves 58 travel through the crevices formed by the bedding 54 and the bottom surface 28 of the pillow 20, to the lower opening 32 thereof, up hole 22, and into the ear 50 of the user 48. When the user's arm 60 is underneath pillow 20, a larger area is created for sound waves 58 to travel and reach his or her ear 50 more directly.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of the invention.

Having thus described the invention, what is desired to be protected by Letters Patent is presented in the subsequently appended claims.

What is claimed is:

1. A pillow for permitting a reclining user to hear sounds, comprising an upper major surface and a lower major surface and having at least one hole extending through the entire thickness of said pillow, from said upper major surface to said lower major surface thereof wherein said at least one hole has dimensions large enough to receive a user's ear, and wherein said at least one hole is filled with sound transmitting material.

2. A pillow for permitting a reclining user to hear sounds, comprising an upper major surface and a lower major surface and having at least one hole extending through the entire thickness of said pillow, from said upper major surface to said lower major surface thereof wherein said at least one hole has dimensions large enough to receive a user's ear, further comprising a pillowcase having at least one hole on the major surface thereof corresponding to said hole of said upper and lower major surfaces of said pillow, and wherein said at least one pillowcase hole is filled with a soft mesh material.

3. The pillow in accordance with claim 2, wherein said pillowcase is open at one end.

4. The pillow in accordance with claim 2, wherein said pillowcase comprises a soft mesh material.

5. A pillow for permitting a reclining user to hear sounds, comprising an upper major surface and a lower major surface and having a plurality of holes extending through the entire thickness of said pillow, from said upper major surface to said lower major surface thereof, wherein said plurality of holes has dimensions large enough to receive a user's ear, and said plurality of holes is filled with sound transmitting material.

* * * * *